US007371957B2

(12) United States Patent
Nishibori

(10) Patent No.: US 7,371,957 B2
(45) Date of Patent: May 13, 2008

(54) PERFORMANCE APPARATUS AND TONE GENERATION METHOD THEREFOR

(75) Inventor: Yu Nishibori, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 11/398,979

(22) Filed: Apr. 6, 2006

(65) Prior Publication Data

US 2006/0236846 A1 Oct. 26, 2006

(30) Foreign Application Priority Data

Apr. 6, 2005 (JP) ..... 2005-109598

(51) Int. Cl.
*G10H 7/02* (2006.01)

(52) U.S. Cl. ..... 84/604

(58) Field of Classification Search ..... 84/601, 84/602, 603, 604, 464 A, 464 R, 744, 745
See application file for complete search history.

(56) References Cited

U.S. PATENT DOCUMENTS

| | | | | |
|---|---|---|---|---|
| 3,562,394 | A | 2/1971 | Keipe | |
| 4,031,800 | A | 6/1977 | Thompson | |
| 4,089,246 | A | 5/1978 | Kooker | |
| 4,123,960 | A | 11/1978 | Franzmann | |
| 4,384,503 | A | 5/1983 | Gunn | |
| 4,422,365 | A | 12/1983 | Iwaki | |
| 5,027,689 | A | 7/1991 | Fujimori | |
| 5,088,378 | A | 2/1992 | DeLaTorre | |
| 5,247,864 | A | 9/1993 | Konishi | |
| 5,530,898 | A | 6/1996 | Miyake | |
| 5,665,927 | A | 9/1997 | Taki et al. | |
| 5,684,259 | A | 11/1997 | Horii | |
| 5,741,990 | A | 4/1998 | Davies | |
| 5,831,195 | A * | 11/1998 | Nakata | 84/609 |
| 5,908,997 | A | 6/1999 | Arnold et al. | |
| 5,936,180 | A * | 8/1999 | Ando | 84/604 |

(Continued)

FOREIGN PATENT DOCUMENTS

DE 100 42 300 A1 3/2002

(Continued)

OTHER PUBLICATIONS

Propellerhead Reason Operation Manual. Ludvig Carlson, Anders Nodrmark, and Roger Wiklander. 2000.*

(Continued)

*Primary Examiner*—Lincoln Donovan
*Assistant Examiner*—Andrew Millikin
(74) *Attorney, Agent, or Firm*—Rossi, Kimms & McDowell LLP

(57) ABSTRACT

A plurality of key switches are disposed in a predetermined arrangement, such as a matrix arrangement, and a tone generator includes a memory for storing tone (waveform) data corresponding to the key switches. Sampling section acquires an audio signal from an external source, cuts out tone data from the acquired audio signal and writes the cut-out tone data into the memory in association with the key switches. Any one of the key switches is designated on the basis of switch operation by a user or on the basis of automatic performance information, so that, of the tone data stored in the memory, the tone data corresponding to the designated key switch is sounded, i.e. audibly reproduced.

11 Claims, 10 Drawing Sheets

U.S. PATENT DOCUMENTS

| | | | |
|---|---|---|---|
| 6,160,213 | A | 12/2000 | Arnold et al. |
| 6,179,432 | B1 | 1/2001 | Zhang et al. |
| 6,347,998 | B1 | 2/2002 | Yoshitomi et al. |
| 6,670,535 | B2 | 12/2003 | Anderson et al. |
| 2002/0105359 | A1 | 8/2002 | Shimizu et al. |
| 2002/0134223 | A1 | 9/2002 | Wesley |
| 2003/0015087 | A1 | 1/2003 | Haken |
| 2006/0005693 | A1 | 1/2006 | Nishibori et al. |
| 2007/0022865 | A1 | 2/2007 | Nishibori et al. |
| 2007/0022868 | A1 | 2/2007 | Nishibori et al. |

FOREIGN PATENT DOCUMENTS

| | | | |
|---|---|---|---|
| EP | 0632427 | A2 | 1/1995 |
| EP | 1710784 | A1 | 11/2006 |
| EP | 1748415 | A2 | 1/2007 |
| EP | 1748418 | A1 | 1/2007 |
| JP | 53-028414 | | 3/1978 |
| JP | 02-074997 | A | 3/1990 |
| JP | 03-182798 | A | 8/1991 |
| JP | 4-285765 | A | 10/1992 |
| JP | 7-325579 | A | 12/1995 |
| JP | 08-006549 | A | 1/1996 |
| JP | 8-110826 | A | 4/1996 |
| JP | 08-221074 | A | 8/1996 |
| JP | 09-068980 | A | 3/1997 |
| JP | 09-212157 | A | 8/1997 |
| JP | 09-319362 | A | 12/1997 |
| JP | 10-097251 | A | 4/1998 |
| JP | 2001-009152 | A | 1/2001 |
| JP | 2002-175080 | A | 6/2002 |
| JP | 2002-229567 | A | 8/2002 |
| JP | 2003-177754 | A | 6/2003 |
| JP | 2004-271783 | A | 9/2004 |
| JP | 2004-274570 | A | 9/2004 |

OTHER PUBLICATIONS

Notice of Preliminary Rejection issued for corresponding Korean Patent Application No. 10-2006-0031407, dated Jan. 24, 2007.

"Keitai News", [online], Jan. 16, 2002, ascii, Japan (with English translation).

Toshio Iwai, "World of Digista Curator," [online], Digital Stadium, Japan (with English translation).

European Search Report of corresponding European Patent Application No. 06007180.0.

Extended European Search Report of corresponding European Patent Application No. 06015696.5-2218, dated Nov. 20, 2006.

Notice of Grounds for Rejection issued in corresponding Japanese Patent Application No. 2005-293369, with mailing date Feb. 27, 2007.

Notice of Grounds for Rejection, issued in corresponding Japanese Patent Application No. 2005-109598, with mailing date Feb. 27, 2007.

KORG Kaoss Pad KP2 Owner's Manual.2002., no month.

KORG Kaoss Pad KP2 Website; Accessed May 23, 2007. <http://www.korg.com/gear/info.asp?a_prod_no_no=KP2>.

Specification and drawings of unpublished U.S. Appl. No. 11/681,899, filed Mar. 5, 2007; Performance Apparatus and Tone Generation Method; Yu Nishibori et al.; pp. 1-60.

Office Action issued on Nov. 17, 2006 in Japanese Patent Application No. 2004-200689, from which related co-pending U.S. Appl. No. 11/176,645 claims priority.

Office Action issued on Nov. 17, 2006 in Japanese Patent Application No. 2004-200690, from which related co-pending U.S. Appl. No. 11/176,645 claims priority.

Hajime Tachibana Design and NTT Learning systems Corporation released i-Appli that changes cellular phone to music sequencer; disclosed in "Keitai News" on Jan. 16, 2002.

"TENORI-ON" disclosed in "The World of Digital Stadium Curator", pp. 1-7, on the internet (www.nhk.or.jp/digista/lab/digista_ten/curator.html.).

Japanese Office Action (Decision of Rejection) issued Jan. 30, 2007 in Japanese Patent Application No. 2004-200690 from which related co-pending U.S. Appl. No. 11/176,645 claims priority.

European Search Report for European Patent Application No. EP 06015695 which corresponds to related co-pending U.S. Appl. No. 11/495,467; mailing date of Feb. 6, 2007; pp. 2-12.

Partial European Search Report of European Patent Application No. 06015695 which corresponds to related co-pending U.S. Appl. No. 11/495,467; mailing date of Oct. 26, 2006.

"Yamaha's Tenori-On LED-panel instrument", retrieved from http://www.engadget.com, Weblogs, Inc, 2003-2007.

"Keitai News", retrieved from http://k-tai.ascii24.com/k-tai/new/2002/01/16/632762-000.html, on Jan. 16, 2002.

"World of Digista Curator" Digital Stadium, Toshio Iwai.

"Tenor-On", retrieved fro http://www.global.yamaha.com/design.

Office Action issued in European application No. EP 07103475.5, mailed on Jul. 13, 2007 which corresponds to a co-pending related application.

Notice of Grounds for Rejection issued in Japanese Patent Appl. No. 2005-293369 which corresponds to related co-pending U.S. Appl. No. 11/493,739. Mailing date Jun. 19, 2007.

Extended European search report issued Nov. 13, 2007 in corresponding European patent application EP07103475.5; pp. 1-14. This European application corresponds to related co-pending U.S. Appl. No.: 11/681,899.

* cited by examiner

PERFORMANCE APPARATUS AND TONE GENERATION METHOD THEREFOR

BACKGROUND OF THE INVENTION

The present invention relates to a performance apparatus which receives user's performance operation of a plurality of switches and executes a music performance in accordance with the performance operation, and a tone generation method and computer program for the performance apparatus.

Application called "TENORI-ON" has been know from, for example, 1) "Keitai News", [online], Jan. 16, 2002, ascii, [searched on Apr. 1, 2004], Internet <URL: http://k-tai.ascii24.com/k-tai/news/2002/01/16/632762-000. html?geta>, and 2) "World of Digista Curator", [online], Digital Stadium, Toshio Iwai, Exhibit=TENORI-ON, [searched on Apr. 1, 2004], Internet <URL: http://www.nhk.or.jp/digiata/lab/digista ten/curator.html>. In performance apparatus, such as portable telephones and game apparatus, executing the application "TENORI-ON", point-designating inputs entered by a user are received via a 16×16 grid arranged on a matrix in such a manner that the horizontal axis represents the timing and the vertical axis represents the tone pitch. Each of such performance apparatus sequentially generates, at predetermined timing, tone pitches corresponding to user-designated points from a leftmost row onward. In this way, the user can use the performance apparatus to compose and perform simple music pieces with high ingenuity.

The conventionally-known performance apparatus, which include a tone generator (e.g., MIDI tone generator), cause the tone generator to generate tones, using information indicative of tone colors of performance tones and tone pitches to be allocated to individual designating points on the grid, to thereby generate a tone pitch corresponding to each user-designated point with a predetermined tone color.

Therefore, the conventionally-known performance apparatus can only perform with tone colors of a predetermined pattern. Further, because given tone pitches are allocated to the designating points, the conventionally-known performance apparatus would unavoidably present performance limitations in terms of diversity of performance tones.

SUMMARY OF THE INVENTION

In view of the foregoing, it is an object of the present invention to provide an improved performance apparatus which can perform music with a variety of performance tones and with high ingenuity, as well as a tone generation method and computer program for the performance apparatus.

In order to accomplish the above-mentioned object, the present invention provides an improved performance apparatus, which comprises: a plurality of key switches disposed in a predetermined arrangement; a memory that stores a plurality of tone data corresponding to the key switches; a sampling section that acquires an audio signal, cuts out tone data from the acquired audio signal and writes the cut-out tone data into the memory in association with the key switches; and a tone generation section that audibly sounds any one of the tone data, stored in the memory, corresponding to a designated one of the key switches.

In the performance apparatus of the present invention, the sampling section acquires an audio signal, cuts out tone data from the acquired audio signal and writes the cut-out tone data into the memory in association with the key switches. Then, of the tone data stored in the memory, the tone data corresponding to a user-operated switch is audibly sounded by the tone generation section. Namely, the tone data cut out from the audio signal are associated with the key switches, so that a particular tone corresponding to user's operation of the key switch is generated. Thus, by switching the audio signal to be acquired from one to another, the present invention allows a variety of tone data to be associated with the key switches, so that it can achieve a variety of performances by generating tones using the variety of tone data.

As an example, the sampling section detects a silent section of the audio signal and cuts out, as the tone data, at least part of the audio signal other than the detected silent section. With the arrangement that the silent section is cut out as the tone data, it is possible to effectively prevent the silent section from being cut out to make undesired silence.

As an example, the plurality of key switches are arranged in given order, and the sampling section detects respective frequencies of the individual tone data cut out from the audio signal and associates the individual tone data to the plurality of key switches in order of the frequencies. With this arrangement, the tone data cut out in the order of the frequencies can be associated with the key switches, and thus, the tone data can be associated with the key switches in the order of tone pitches.

As an example, the sampling section detects a start point or position of a phoneme in the audio signal and acquires, as the tone data, sound data having a predetermined length from the detected start position of the phoneme. This arrangement can reliably prevent tone data from being cut out at a point partway through the phoneme.

The present invention may be constructed and implemented not only as the apparatus invention as discussed above but also as a method invention. Also, the present invention may be arranged and implemented as a software program for execution by a processor such as a computer or DSP, as well as a storage medium storing such a software program. Further, the processor used in the present invention may comprise a dedicated processor with dedicated logic built in hardware, not to mention a computer or other general-purpose type processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which.

DETAILED DESCRIPTION OF THE INVENTION

Now, with reference to the accompanying drawings, a description will be given about a performance apparatus in accordance with the present invention. This performance apparatus includes a plurality of key switches disposed in a matrix arrangement, and it generates a tone in response to depression (performance operation), by a user, of any one of the switches. The performance apparatus receives an audio signal from an external source (outside the performance apparatus), clips out or cuts out and acquires tone data, corresponding to the key switches, from the audio signal, and generates a tone corresponding to the performance operation using the acquired tone data. Thus, the performance apparatus of the present invention can acquire diverse tone data by switching the audio signal, from which tone data are to be cut out, and thereby execute a variety of music performances.

FIRST EMBODIMENT

Figure 1:
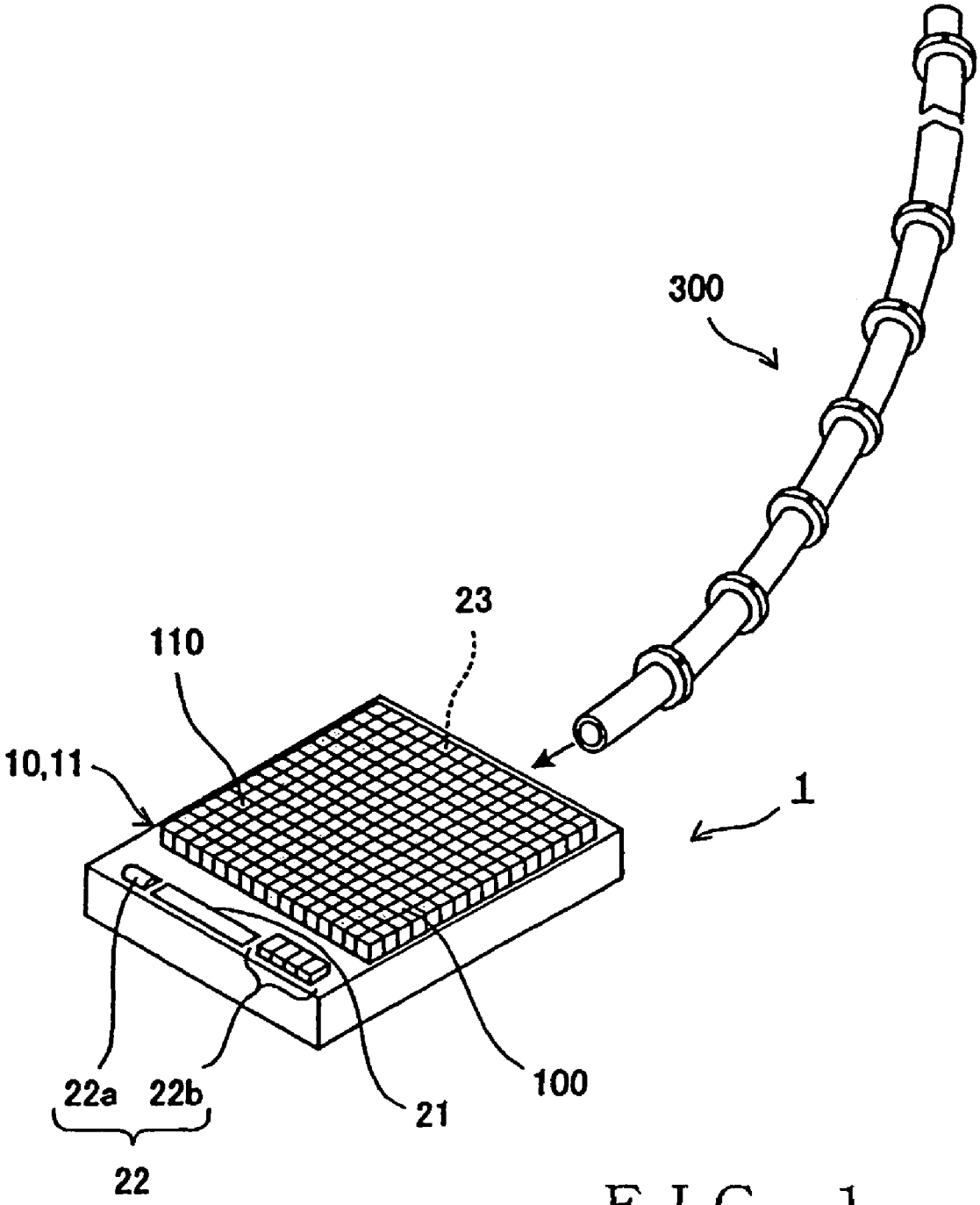
FIG. 1 is a perspective view showing an outer appearance of a performance apparatus in accordance with a first embodiment of the present invention.
Figure 2:
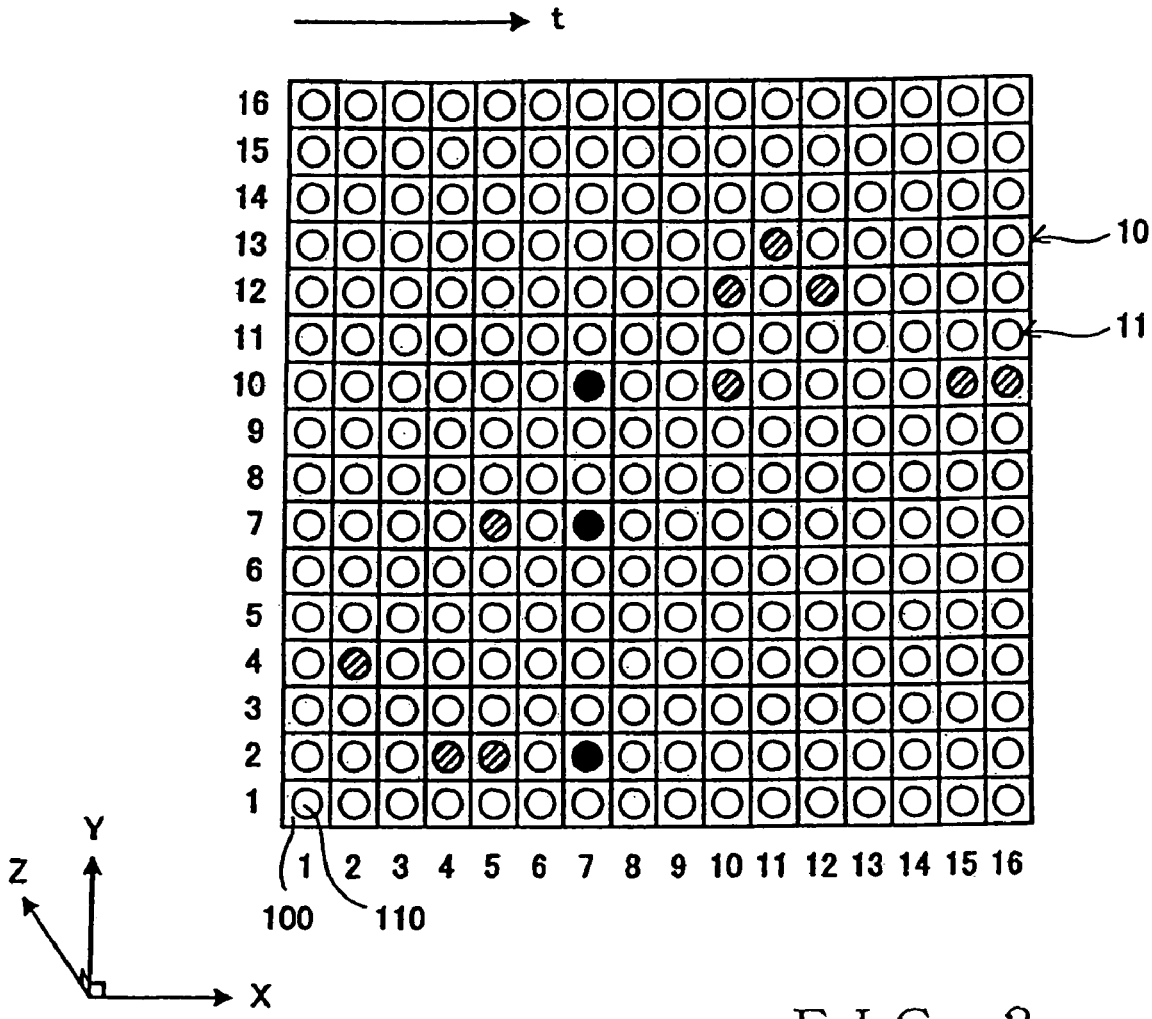
FIG. 2 is a view showing example structures of a key switch group and light-emitting display portions in the first embodiment of the present invention.

Performance apparatus 1 according to a first embodiment of the present invention will be described with reference to FIGS. 1-8. FIG. 1 is a perspective view showing an example outer appearance of the first embodiment of the performance apparatus 1, and FIG. 2 is a view showing example structures of a key switch group 10 and light-emitting display portions 110, provided in corresponding relation to the key switches, taken from a front side of the performance apparatus 1 closer to a user operating the apparatus 1. The performance apparatus 1 is generally in the shape of a flat, rectangular parallelepiped and has, on its upper surface, the key switch group 10 comprising a multiplicity of key switches (hereinafter referred to simply as "switches") 100 disposed in a matrix arrangement. More specifically, the switch group 10 comprises a total of 256 switches, i.e. 16 switches in the vertical direction and 16 switches in the horizontal direction, and these 256 switches are arranged in a matrix.

Each of the switches 100 is a push switch, in which the corresponding light-emitting display portion 110, provided with an LED or the like, is incorporated, and the light-emitting display portions 110 of all of the switches 100 together constitute a light-emitting display portion group 11. Each of the light-emitting display portions 110 is illuminated, for example, in response to the corresponding switch 100 being depressed with a finger or the like of the user. Position of each of the switches 100 of the switch group 10 and each of the light-emitting display portions 110 of the display portion group 11 can be indicated by X-Y coordinates with the Y-coordinate representing a location in a front-back direction (the vertical direction in FIG. 2) and the X-coordinate representing a location in a left-right direction (the horizontal direction in FIG. 2). Hereinafter, the coordinates of the leftmost and lowermost light-emitting display portion 110, for example, are indicated as "mtLED(1, 1)", and the coordinates of the leftmost and lowermost switch 100, for example, are indicated as "mtSW(1, 1)".

On a front area of the performance apparatus 1, located closer to the user operating the apparatus 1 than the above-mentioned switch group 10 and light-emitting display portion group 11, there is provided an operation section 22, which includes a liquid crystal display section 21, an encoder switch 22*a* operable to accept user's operation and a plurality of operation buttons 22*b*. Further, on a rear end surface of the performance apparatus 1, there is provided an input terminal 23 for connection thereto one end of a connection cable 300. The connection cable 300 is connected, at the other end, to another equipment (e.g., another performance apparatus 1), so that the performance apparatus 1 can communicate with the other equipment via the connection cable 300.

Figure 3:
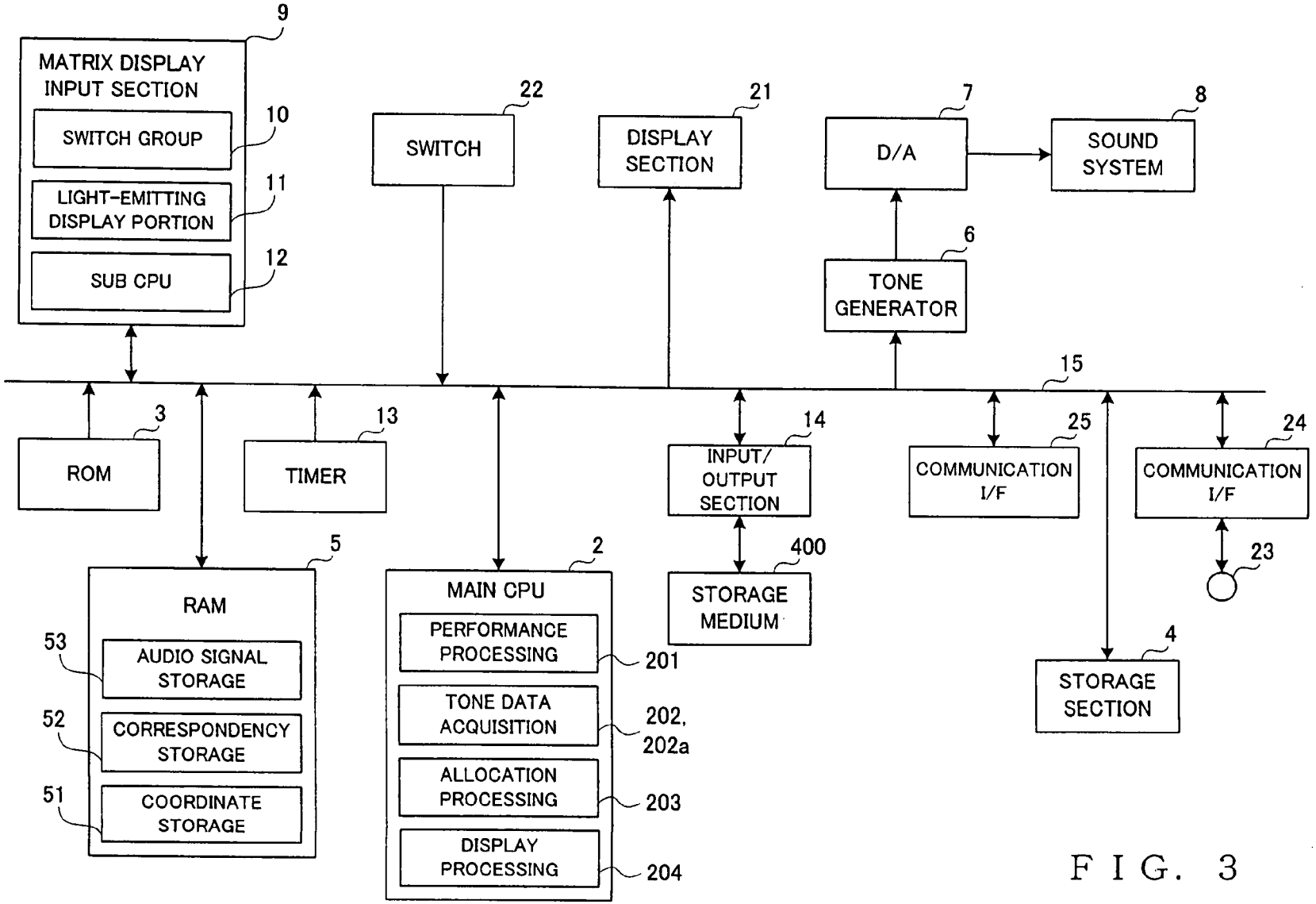
FIG. 3 is a block diagram showing an example electrical construction of the performance apparatus shown in FIG. 1.

FIG. 3 is a block diagram showing an example electrical construction of the performance apparatus 1 shown in FIG. 1. The performance apparatus 1 comprises a main CPU (Central Processing Unit) 2, and a ROM (Read-Only Memory) 3, storage section 4, RAM (Random Access Memory) 5, tone generator (T.G.) 6, D/A (Digital-to-Analog) converter 7, sound system 8, matrix display input section 9 and input/output section 14 connected to the CPU 2 via a bus 15.

The ROM 3 has stored therein programs for running the performance apparatus 1. The storage section 4 comprises storage means, such as a flash memory or hard disk, which is rewritable and capable of storing data. In the storage section 4, there are stored predetermined programs, such as a performance processing program for causing the performance apparatus 1 to execute a music performance, as well as predetermined data necessary for the execution of the programs. The necessary data include, for example, tone generation setting data that are data indicative of correspondency between the switches 100 of FIG. 1 and tone pitches allocated to the switches 100 and also indicative of a tone color to be set by default in the tone generator 6. The tone generation setting data are described on the basis of, for example, the MIDI (Musical Instrument Digital Interface) standard.

The RAM 5 functions as a working area for the main CPU 2, where are temporarily stored a program and data read out from the storage section 4. Further, the RAM 5 includes a coordinate storage section 51 storing data indicative of the coordinates of the individual switches 100 of the switch group 10, a correspondency storage section 52 and an audio signal storage section 53.

The coordinate storage section 51 is provided for storing ON/OFF states of the individual switches 100. The coordinate storage section 51 comprises a 16×16 table having storage locations corresponding in arrangement to the switches 100 of the switch group 10 shown in FIG. 2, and each of the storage locations of the coordinate storage section 51 comprises a one-bit flag. When any one of the switches 100 has been depressed for more than a predetermined time, the storage location corresponding to the depressed switch 100 is set at "1". State in which the storage location is at "1" represents the ON state of the corresponding switch 100, while a state in which the storage location is at "0" represents the OFF state of the corresponding switch.

Further, the correspondency storage section 52 stores therein a note number table T containing a list of note numbers allocated to the individual switches 100. In the note number table T employed in the instant embodiment, 16 note numbers are allocated, by default (or by initial setting), to the 16 Y-coordinates (=1-16); the same 16 note numbers are allocated to each of 16 Y-coordinate groups (or columns) corresponding to the X-coordinates (=1-16) so that the same tone pitches are selectable for each of the 16 X-coordinates, i.e. 16 timing. Here, the "note number" is a numerical value indicative of a tone pitch or the like, which is given from a later-described performance processing section 201 to the tone generator 6; note number "60" is indicative of a center scale note "C4". In the instant embodiment, note numbers "60" to "75" are sequentially allocated to the Y-coordinates; according to the default settings at start-up, note number "60" is allocated to Y-coordinate "1", note number "61" to Y-coordinate "2", and so on, until note number "75" is allocated to Y-coordinate "16".

In the illustrated example, different note numbers are allocated only to the 16 Y-coordinates (i.e., the same note numbers are allocated to each of the groups or columns of 16 Y-coordinates so that the same note numbers are selectable for each of the X-coordinates or timing), as set forth above. Alternatively, a different note number may be allocated to each of the 16×16 (=256) switches 100. Further, the note numbers to be allocated to the switches 100 are not limited to the range of "60"-"70".

The audio signal storage section 53 is provided for temporarily storing an externally-acquired audio signal.

The tone generator 6 is, for example, a MIDI tone generator (i.e., tone generator capable of generating a tone or audio waveform signal in accordance with MIDI information), which generates a digital audio (tone) signal with a predetermined tone color and passes the generated digital audio signal to the D/A converter 7. In the instant embodiment, the tone generator 6 can generate, on the basis of tone data (waveform data) stored in memory, digital audio (tone) signals of any of not only a plurality of kinds of internally-stored tone colors or internal tone colors (e.g., piano tone color, guitar tone color, etc.) but also externally-acquired desired tone colors (external tone colors). In the tone generator 6, a plurality of kinds of tone data are set, as the tone waveform data of the external tone colors, with respective note numbers assigned thereto. For example, the tone generator 6 includes a readable/writable non-volatile memory for storing external tone color data, and a plurality of kinds of tone data (waveform data) of the above-mentioned external tone colors) are stored in the memory with respective predetermined note numbers assigned thereto in accordance with their tone pitch frequencies. The note numbers are associated with the switches 100 through the above-mentioned note number table T; namely, the plurality of kinds of tone data are assigned respective note numbers in accordance with their respective pitches, so that they are associated with the switches 100. The tone generator 6 receives, from the main CPU 2, not only tone color designation but also note number designation of a tone to be generated, to thereby read out, from the above-mentioned memory, tone data (waveform data) based on the designated tone color and tone number. Thus, the tone generator 6 generates a digital audio (tone) signal on the basis of the read-out tone data (waveform data) so that the digital audio signal is audibly reproduced or sounded for a predetermined time length (e.g., 200 msec). Note that the note number of the tone to be generated can be designated either by the user turning on a desired one of the switches 100 or on the basis of separately-stored automatic performance information. Note that the tone data (waveform data) to be stored in the memory may be in any desired compressed format other than the PCM format, such as DPCM or ADPCM format.

The D/A converter 7 converts the digital audio signal, received from the tone generator 6, into an analog audio signal and supplies the analog audio signal to the sound system 8. The sound system 8 audibly reproduces or sounds the supplied analog audio signal.

The matrix display input section 9 comprises the switch group 10 and light-emitting display portion group 11 described above in relation to FIG. 1, and a sub CPU 12.

The sub CPU 12 detects the coordinates of each depressed switch 100 (FIG. 2) and supplies the detected coordinates to the main CPU 2 as depressed switch position information.

Timer 13 counts time to inform the main CPU 2 of the counted time. The input/output section 14 is an interface circuit for inputting/outputting data from/to a storage medium 400, such as an SD card (registered trademark) or floppy (registered trademark) disk.

The main CPU 2, which controls operation of each component connected thereto, executes a performance program to function as a performance processing section 201, tone data acquisition section 202, allocation processing section 203 and display processing section 204.

The performance processing section 201 uses the tone generation setting data stored in the storage section 4 to control the audio signal generation by the tone generator 6 so that a tone corresponding to the switch 100 operated by the user for a music performance is generated. More specifically, as an initialization operation, the performance processing section 201 designates a predetermined tone color to the tone generator 6 and registers, by initial setting, the note numbers, corresponding to the Y-coordinate locations of the individual switches 100, in the note number table T.

The performance processing section 201 receives the depressed switch position information from the sub CPU 12 to acquire the coordinates of the depressed switch 100.

The performance processing section 201 refers to the note number table T to identify the note number corresponding to the informed coordinates and inform the tone generator 6 of the identified coordinates. Thus, the tone generator 6 generates an audio signal, corresponding to the switch 100 depressed by the user, with a currently-set set tone color. In this way, the user can execute performance operation using the switch group 10 like a keyboard.

When any one of the switches 100 has been depressed for more than the predetermined time length, the performance processing section 201 sets, i.e. turns ON, the flag at the storage location corresponding to the user-depressed switch 100. The ON state is canceled, i.e. the set flag is reset, by the performance processing section 201 in response to the ON-state switch 100 being kept depressed for a long time. Then, once the performance processing section 201 receives an instruction for selecting automatic performance settings which has been given by the user via the switch 22, it carries out automatic processing. In the automatic performance processing, the performance processing section 201 repetitively moves a to-be-sounded note string pointer P from the left end to the right on the coordinate storage section 51. The performance processing section 20 instructs the tone generator 6 to generate a tone only for a time when the to-be-sounded note string pointer P and the storage location of any of the switches 100 in the ON state are overlapping each other. Thus, in the automatic performance processing, tone pitches are expressed on the Y axis while tone generation timing is expressed on the X axis, so that the performance apparatus 1 is allowed to execute a music performance with ease.

The "to-be-sounded note string pointer" P is a pointer for instructing tone generation of a note, for which the flat is at the value "1", of all of the notes on the Y-axis coordinates (i.e. all of the notes in a column) corresponding to a specific X-axis coordinate location in the coordinate storage section 51. With the X-coordinate location, indicated by the to-be-sounded note string pointer P, sequentially varying from "1" to "16" in a repeated fashion, an automatic performance of notes programmed at tone generation timing "1" to "16" is carried out repeatedly.

Further, when an instruction for changing tone generator settings ("tone color generator setting change instruction") has been given by the user, the performance processing section 201 performs processing (tone generator setting change processing) for changing a tone color and key allocation to be set in the tone generator 6. Specifically, when an instruction for changing settings about tone generation (tone pitches etc.) allocated to the switches 100 has been received from the user, the key allocation setting change is effected by the performance processing section 201 changing, in accordance with the instruction, the correspondency between the key switches 100 and the note numbers registered in the note number table T.

Further, the performance processing section 201 can change the tone color set in the tone generator 6 to either an internal tone color or to an external tone color, as noted above. When an instruction for selecting a mode for setting an external tone color (i.e., tone generating data performance mode), the performance processing section 201 performs an external tone color setting process for setting audio data (tone data) cut out from an externally-acquired audio signal, in the tone generator 6 as an external tone color.

In the external tone color setting process, the performance processing section 201 causes a tone data acquisition section 202 to acquire, from the externally-acquired audio signal, tone data corresponding in number to the Y-coordinates of the switches 100 (in this case, 16 tone data). Then, the performance processing section 201 causes the allocation processing section 203 to associate the individual tone data with the Y-coordinates of the switches 100. Such association is carried out by referring to the note number table T so as to allocate the note numbers, corresponding to the switches 100, to the tone data and set the tone data with the respective note numbers in the tone generator 6. For example, each portion having a particular tone pitch is extracted from the externally-acquired audio signal, and the thus-extracted portion is cut out as tone data having the particular tone pitch.

Because, as note above, the tone data cut out from the externally-acquired audio signal can be set as an external tone color, the instant embodiment can acquire various external tone colors by switching the audio signal from one to another and thereby generate a great variety of tones.

The tone data acquisition section 202 expands or decompresses an audio signal input from the storage medium 400 via the input/output section 14 or audio signal downloaded from an external source via a later-described communication I/O 24 or 25, stores the thus-decompressed audio signal into the audio signal storage section 53, and then acquires tone data from the audio signal in the manner as set forth above. The audio signal, which is for example in the MP (MPEG audio layer) 3 format, is a signal representative of a music piece, such as a Japanese popular song. Processing performed by the tone data acquisition section 202 will be later described in detail with reference to a flow chart of FIG. 7. The allocation processing section 203 performs a process for allocating the tone data, acquired by the tone data acquisition section 202, to the switches 100 as will be described in detail with reference to a flow chart of FIG. 7.

The display processing section 204 performs a process (display process) for controlling the light-emitting display made by the light-emitting display portion group 11. In the display process, the display processing section 204 illuminates the light-emitting display portion 110 corresponding to the switch 100, depressed by the user, for the same time as a predetermined tone generation time length. Namely, when the switch 100 is depressed for a short time, the display processing section 204 causes the corresponding light-emitting display portion 110 to be illuminated with a great light intensity, while, when the switch 100 is depressed for a long time to be brought to the ON state, the display processing section 204 causes the corresponding light-emitting display portion 110 to be illuminated with a small light intensity until the ON state is canceled. Further, when the to-be-sounded note string pointer P and the coordinates of the switches 100 in the ON state has overlapped as indicated at mtLED (7, 10), mtLED (7, 7) and mtLED (7, 2), the display processing section 204 causes the corresponding light-emitting display portions 110 to be illuminated with the great light intensity as long as the overlapping lasts and then illuminated with the small light intensity.

Referring back to FIG. 3, the communication I/F 24 and communication I/O 25 are connected via the bus 15 to the main CPU 2. The communication I/F 24 is an interface circuit intended for communication with another equipment connected to the input terminal 23 via the connection cable 300 shown in FIG. 1. The communication I/O 25, on the other hand, is an interface circuit intended for communication via a not-shown wide area network, such as the Internet, or LAN (Local Area Network).

Figure 4:
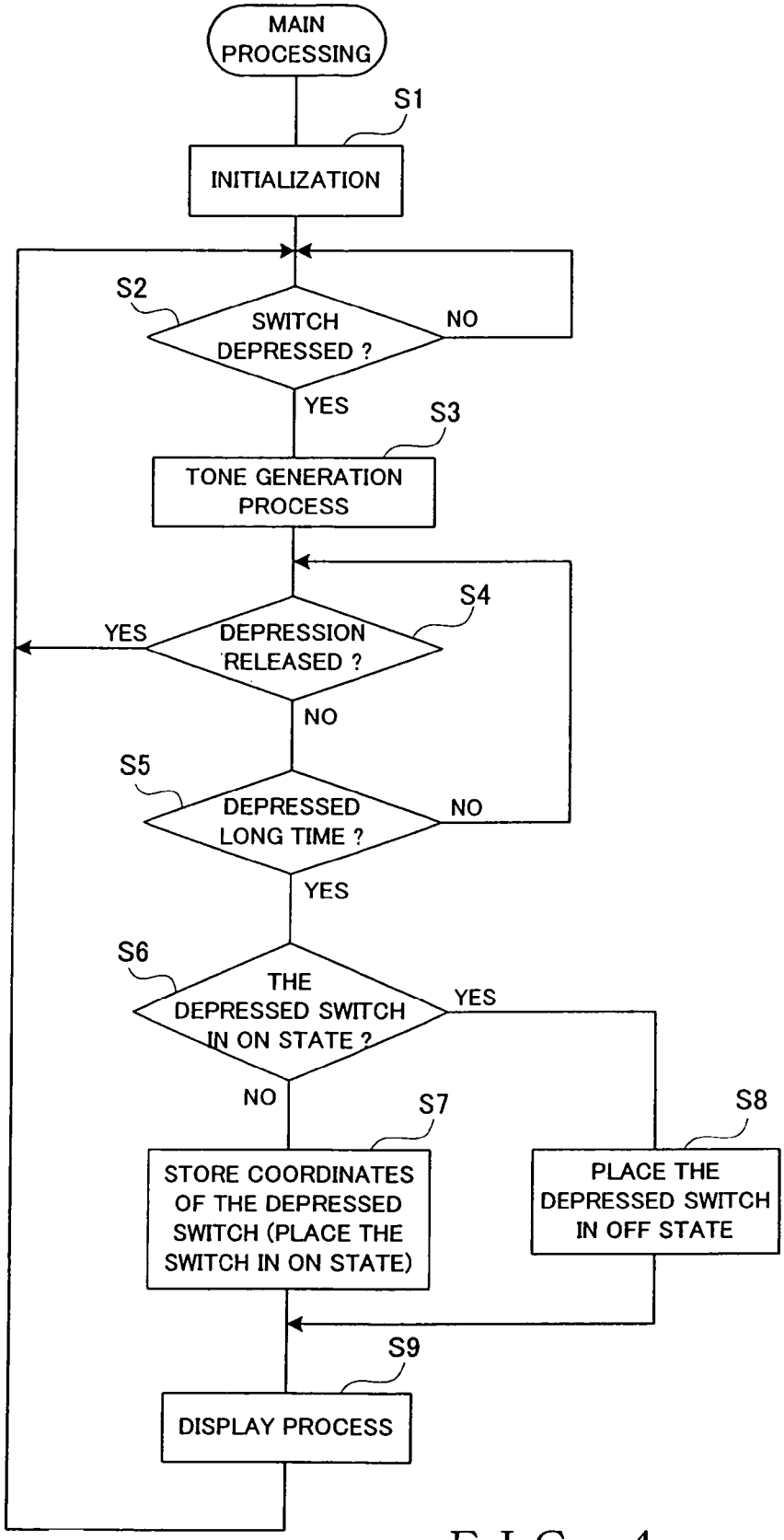
FIG. 4 is a flow chart of main processing performed by the performance apparatus shown in FIG. 3.

FIG. 4 is a flow chart of main processing performed by the performance apparatus 1 shown in FIG. 3. The main processing is executed upon turning-on of a main power supply of the performance apparatus 1. First, at step S1, the performance processing section 201 performs a predetermined initialization process. In the initialization process, the performance apparatus 1 refers to the tone generation setting data stored in the storage section 4 to thereby set a predetermined initial tone color, indicated by the tone generation setting data, in the tone generator 6, and also registers, in the note number table T, correspondency between the note numbers and the switches 100.

Further, the performance processing section 201 starts performing tone generator setting processing that will be later described with reference to a flow chart of FIG. 6, and also starts executing automatic performance processing in response to an automatic performance setting instruction given by the user as will be later described with reference to a flow chart of FIG. 5. Operations of following steps S2-S9 will be carried out for each of the switches 100 in a manner to be described below.

At step S2, the performance processing section 201 determines whether the switch 100 in question has been depressed. If the switch 100 has been depressed, depressed switch position information is supplied from the sub CPU 12 to the performance processing section 201. When such depressed switch position information has been supplied, it is determined that the switch 100 has been depressed. If it is determined that the switch 100 has not been depressed (NO determination at step S2), and if a tone is being generated for any other switch 100 through a tone generation process at step S3, the performance processing section 201 terminates the tone generation for that other switch 100 and then repeats the operation of step S2.

If, on the other hand, it is determined that the switch 100 has been depressed (YES determination at step S2), the performance processing section 201 carries out the above-mentioned tone generation process at step S3.

Namely, the performance processing section 201 is informed, by the depressed switch position information, of the coordinates of the depressed switch 100 and refers to the note number table T using the informed coordinates of the depressed switch 100. Then, the performance processing section 201 acquires the note number corresponding to the depressed switch 100 from the table T and gives the acquired note number to the tone generator 6.

Thus, the tone generator 6 generates an audio signal of the given note number in the set tone color and supplies the generated audio signal to the D/A converter 7. For example, if the currently-set tone color is an internal tone color, the tone generator 6 detects the note number in the set internal tone color (e.g., piano) and identifies the tone pitch corresponding to the detected note number, so that the tone generator 6 generates an audio signal of the identified tone pitch with the set internal tone color (e.g., piano). If, on the other hand, the currently-set tone color is an external tone color, the tone generator 6 detects the note number in the set external tone color and supplies the D/A converter 7 with an audio signal of the tone data corresponding to the detected note number.

Then, the performance processing section 201 determines, at step S4, whether the depression of the switch 100 has been released. The release of the switch 100 can be judged by ascertaining whether or not the input, from the sub CPU 12, of the depressed switch position information has been terminated.

If it is determined that the depression of the switch 100 has been released (YES determination at step S4), the performance processing section 201 reverts to step S2, but, if it is determined that the depression of the switch 100 has not been released (NO determination at step S4), the performance processing section 201 makes a further determination, at step S5, as to whether the switch 100 has been depressed for a long time, i.e. for more than the predetermined time; specifically, this determination is made by ascertaining whether or not the depressed switch position information has been input from the sub CPU 12 for more than a predetermined time.

If it is determined that the switch 100 has not been depressed for more than the predetermined time (NO determination at step S5), the performance processing section 201 reverts to step S4, but, if it is determined that the switch 100 has been depressed for more than the predetermined time (YES determination at step S5), the performance processing section 201 makes a further determination, at step S6, as to whether the depressed switch 100 is in the ON state; specifically, this determination is made by ascertaining whether or not the flag is currently set (at "1") at the storage location, in the coordinate storage section 51, corresponding to the depressed switch 100.

If the depressed switch 100 is not in the ON state (NO determination at step S6), the performance processing section 201 places the depressed switch 100 in the ON state and sets the flag (at "1") at the corresponding storage location in the coordinate storage section 51, at step S7. If the depressed switch 100 is in the ON state (YES determination at step S6), the performance processing section 201 places the depressed switch 100 in the OFF state, i.e. resets the flag (to "0") at the corresponding storage location in the coordinate storage section 51, at step S8.

After that, the performance processing section 201 causes the display processing section 204 to perform a display process, at step S9. In the display process, the display processing section 204 illuminates the light-emitting display portion 110, corresponding to the depressed switch 100, with the great light intensity as long as the depression of the switch 100 lasts. Further, the display processing section 204 illuminates the light-emitting display portion 110, corresponding to the depressed switch 100 having been placed in the ON state, with the small light intensity. Then, the performance processing section 201 reverts to step S2.

Figure 5:
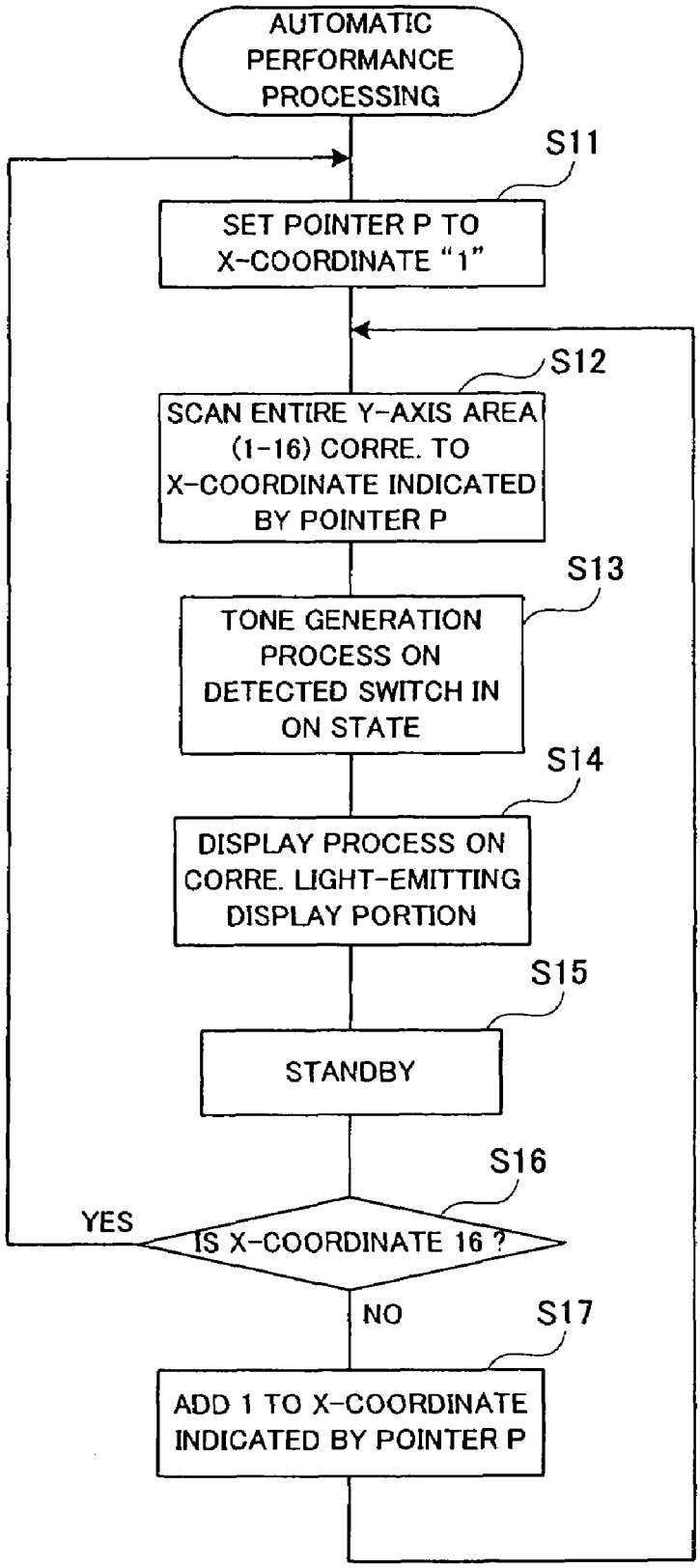
FIG. 5 is a flow chart of automatic performance processing performed by the performance apparatus 1 shown in FIG. 3.

FIG. 5 is a flow chart of the automatic performance processing performed by the performance apparatus 1 shown in FIG. 3. In the automatic performance processing, the performance processing section 201 first positions the to-be-sounded note string pointer P in the area of the X-coordinate "1" of the coordinate storage section 51, at step S11. Next, the performance processing section 201 scans the entire Y-axis area (i.e., all of the Y-coordinates) corresponding to the X-coordinate location indicated by the to-be-sounded note string pointer P, to detect any switch 100 currently in the ON state in the pointer-indicated area (step S12). If the to-be-sounded note string pointer P indicates the area corresponding to the X-coordinate "1", the performance processing section 201 scans from "mtSW(1, 1)" to "mtSW (1, 16)".

The performance processing section 201 performs the above-described processing on the switch 100 currently in the ON state, at step S13. Then, at step S14, the performance processing section 201 causes the display processing section 204 to perform the display process for causing the switch 100 currently in the ON state to be first illuminated with the great light intensity for a predetermined time and then illuminated with the small light intensity. Here, the "predetermined time" corresponds to a time length over which the to-be-sounded note string pointer P and the X-coordinate of the switch 100 overlap each other; therefore, the light-emitting display portion 110 corresponding to the switch 100 is illuminated with the great light intensity for the time length over which, i.e. as long as, the to-be-sounded note string pointer P and the X-coordinate of the switch 100 overlap each other.

Then, the performance processing section 201 stands by for a predetermined time at step S15, and then makes a determination, at step S16, as to whether the area indicated by the to-be-sounded note string pointer P is of the rightmost X-coordinate ("16" in this case). If the area indicated by the to-be-sounded note string pointer P is of the rightmost X-coordinate (YES determination at step S16), the performance processing section 201 reverts to step S11, while, if the area indicated by the to-be-sounded note string pointer P is not of the rightmost X-coordinate (NO determination at step S16), the performance processing section 201 adds "1" to the X-coordinate indicated by the to-be-sounded note string pointer P, namely, moves the to-be-sounded note string pointer P to the next area (i.e., area located to the right of the area so far indicated by the pointer P), at step S17. After that, the performance processing section 201 reverts to step S12.

Figure 6:
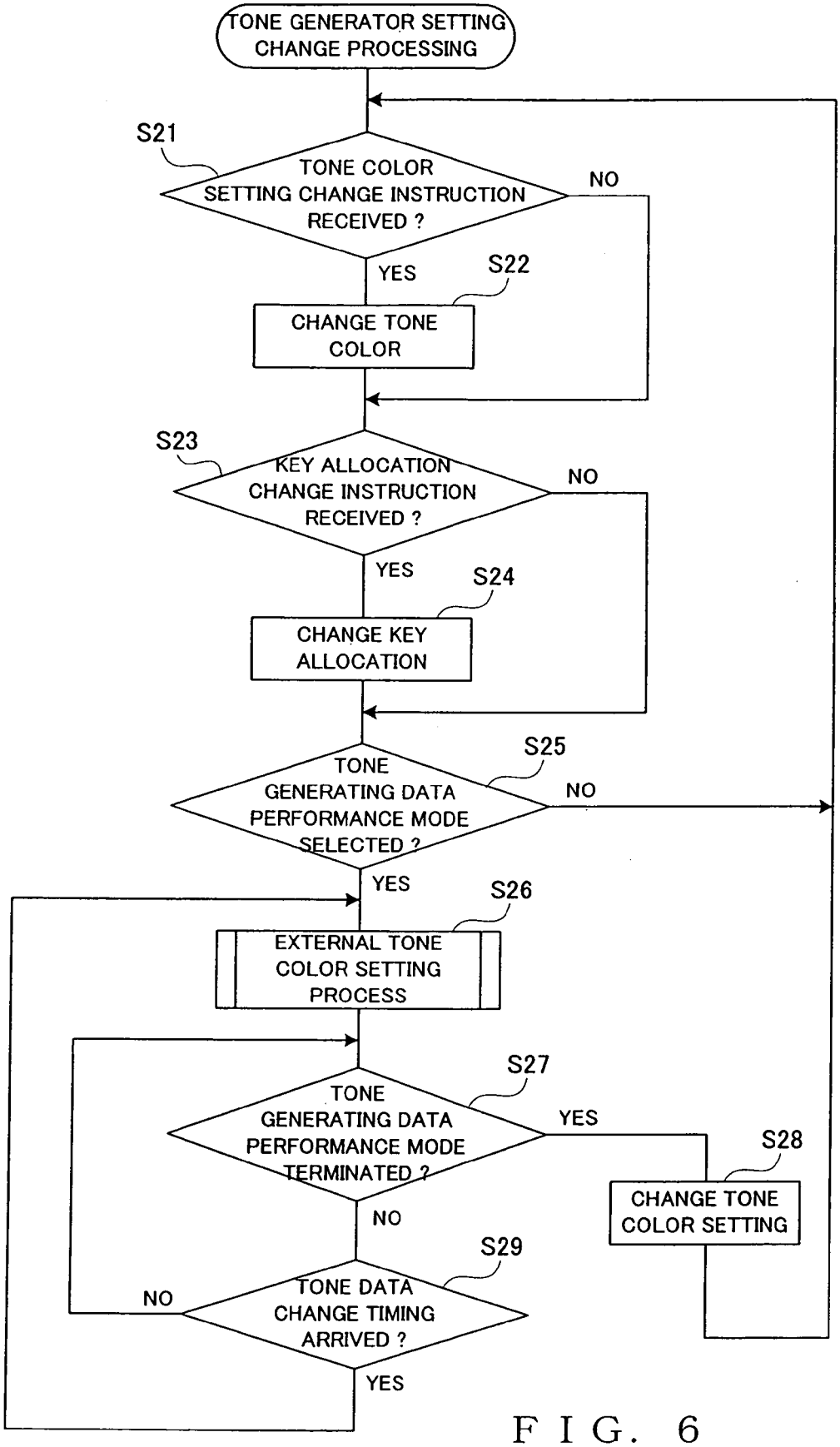
FIG. 6 is a flow chart of tone generator setting change processing performed by the performance apparatus shown in FIG. 3.
Figure 7:
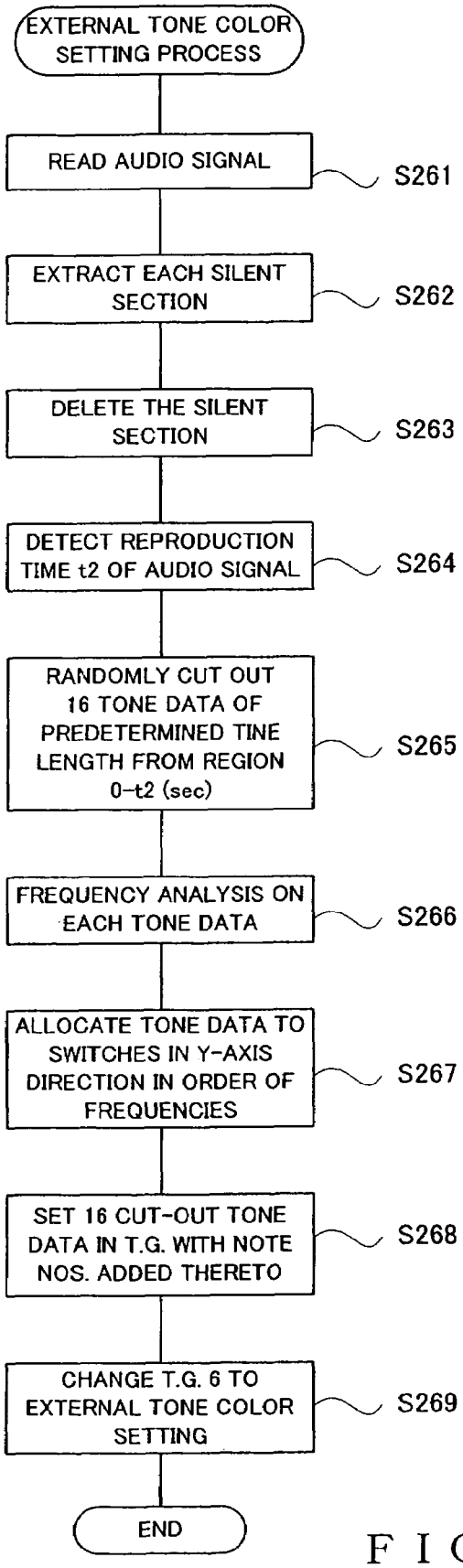
FIG. 7 is a flow chart of an external tone color setting process performed in the tone generator setting change processing of FIG. 6.
Figure 8:
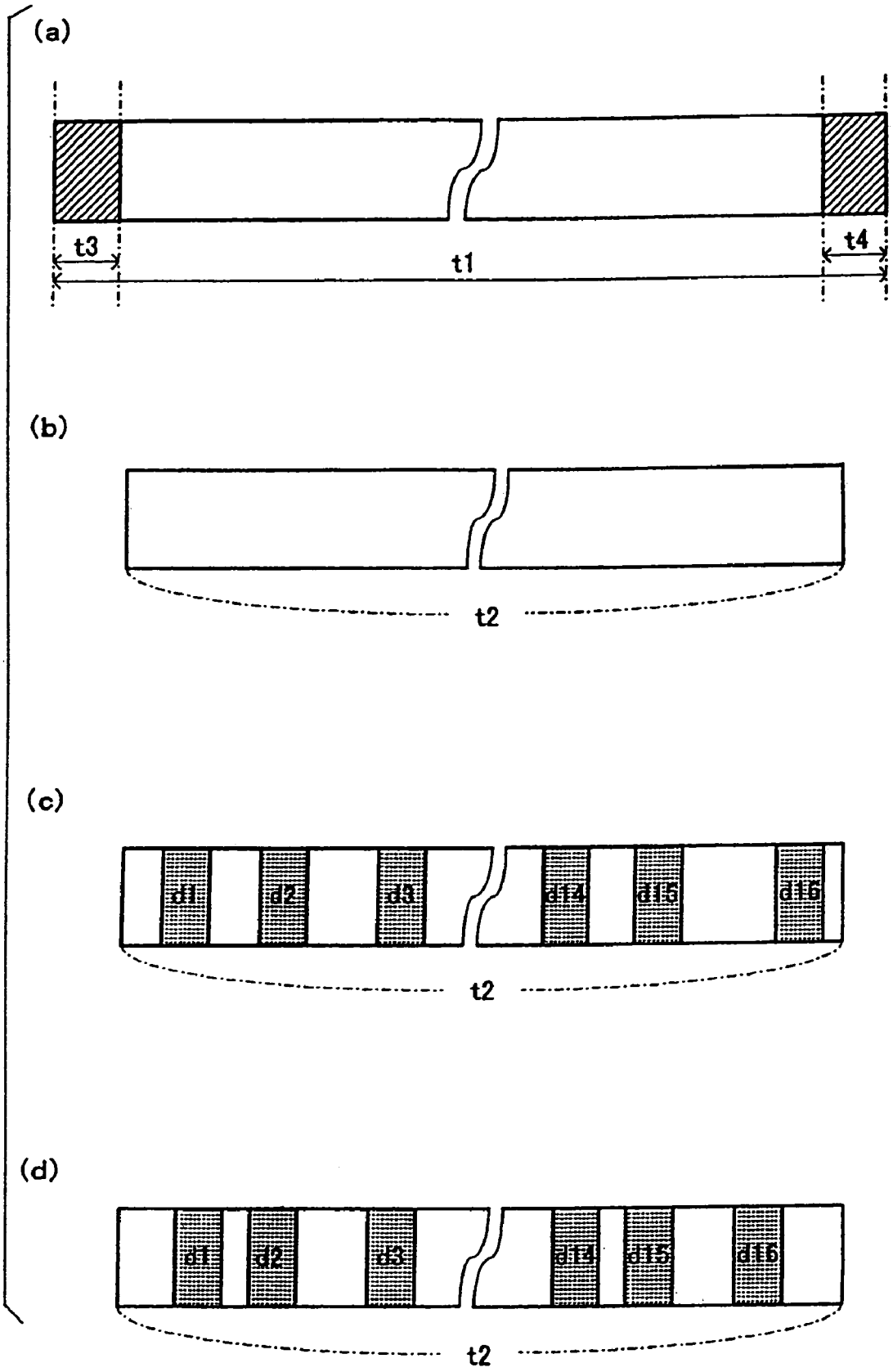
FIG. 8 is a diagram explanatory of an external tone color setting process shown in FIG. 7.

FIG. 6 is a flow chart of the tone generator setting change processing performed by the performance apparatus 1 shown in FIG. 3, and FIG. 7 is a flow chart of external tone color setting process performed in the tone generator setting change processing of FIG. 6. FIG. 8 is a diagram explanatory of an external tone color setting process shown in FIG. 6.

First, at step S21, the performance processing section 201 determines whether a tone color setting change instruction has been received from the user. If no tone color setting change instruction has been received from the user (NO determination at step S21), the performance processing section 201 jumps to step S23, while, if such a tone color setting change instruction has been received from the user (YES determination at step S21), the performance processing section 201 goes to step S22 in order to change the tone color settings as instructed by the user.

Then, at step S23, the performance processing section 201 determines whether a key allocation change instruction has been received from the user. If no key allocation change instruction has been received from the user (NO determination at step S23), the performance processing section 201 jumps to step S25, while, if such a key allocation change instruction has been received from the user (YES determination at step S23), the performance processing section 201 goes to step S24 in order to change the correspondency between the note numbers and the switches 100, registered in the note number table T, in accordance with the user's instruction.

At step S25, the performance processing section 201 determines whether the tone generating data performance mode has been selected by the user. If the tone generating data performance mode has not been selected by the user (NO determination at step S25), the performance processing section 201 reverts to step S21, while, if the tone generating data performance mode has been selected by the user (YES determination at step S25), the performance processing section 201 causes the tone data acquisition section 202 and allocation processing section 203 to perform the external tone color process, at step S26.

In the external tone color process of FIG. 7, the tone data acquisition section 202 reads (or takes in) an audio signal from an external source (outside the performance apparatus 1) at step S261 and then writes the audio signal into the audio signal storage section 53 after decompressing or expanding the audio signal. The tone data acquisition section 202 extracts each silent section from the read (or taken-in) audio signal, at step S262. The extraction is effected by extracting, as the silent section, a section of the audio signal where portions lower in signal level than a predetermined level appear in succession. In an audio signal shown in (a) of FIG. 8, for example, there are such silent sections (indicated as hatched sections) at the leading and trailing ends of the signal, and these silent sections are extracted at step S262.

The tone data acquisition section 202 deletes the extracted silent sections from the audio signal stored in the audio signal storage section 53, at step S263. (b) of FIG. 8 shows the audio signal shown in (a) with the silent sections deleted therefrom. If such silent sections are also extracted as tone data, then the tone data of the silent sections would result in undesired silence; namely, deleting the silent sections at step S263 can effectively prevent the tone data of the silent sections from producing undesired silence.

Further, the tone data acquisition section 202 detects a reproduction time t2 (sec) of the audio signal stored in the audio signal storage section 53, at step S264. As indicated at d1-d16 in (c) of FIG. 8, the tone data acquisition section 202 randomly cuts out, as the tone data, 16 data each having a predetermined length (e.g., 200 msec) from a region from 0 (sec) to t2 (sec) and then stores the cut-out data into the RAM 5, at step S265. Although 16 data are cut out in the illustrated example, any depressed number of tone data, corresponding to the number of the switches 100 in the Y-axis direction, may be cut out at step S265.

The allocation processing section 203 performs frequency analysis, such as the FFT (Fast Fourier Transform), on each of the tone data stored in the RAM 5, at step S266. Through the frequency analysis, the allocation processing section 203 acquires the peak frequency (i.e., frequency having the greatest level among a plurality of frequencies constituting the analyzed tone data, such as a fundamental frequency or pitch frequency) of each of the tone data. The allocation processing section 203 allocates the tone data to the Y coordinates of the individual switches 100 in such a manner that the tone data are associated with the switches of the switch group 10 in the Y-axis direction and in the order of the peak frequencies, at step S267. Namely, each of the Y-coordinate location corresponds to a different tone pitch.

The allocation processing section 203 refers to the note number table T, on the basis of the allocation performed at step S267, to identify the note numbers corresponding to the switches 100. The allocation processing section 203 then adds the thus-identified note numbers to the corresponding tone data and supplies the tone data, with the note numbers added thereto, to the tone generator 6 as an external tone color, at step S268. Then, the performance processing section 201 sets the tone color of the tone generator 6 to the external tone color, at step S269.

Referring back to FIG. 6, the performance processing section 201 determines, at step S27, whether termination of the tone generating data performance mode has been instructed. If it is determined that termination of the tone generating data performance mode has been instructed (YES determination at step S27), the performance processing section 201 reverts to step S21 after resetting the tone color of the tone generator 6 to the initial tone color settings at step S28. If, on the other hand, it is determined that termination of the tone generating data performance mode has not been instructed (NO determination at step S27), the performance processing section 201 further determines, at step S29, whether tone data change timing has arrived. The "tone data change timing" is, for example, a time point when a predetermined time has passed, a time point when a tone data change instruction has been received from the user, or the like.

If the tone data change timing has not arrived (NO determination at step S29), the performance processing section 201 reverts to step S27, while, if the tone data change timing has arrived (YES determination at step S29), the performance processing section 201 reverts to step S26. At step S26, the above-described external tone color setting process is carried out, where tone data is cut out from the audio signal at a different portion from the last portion (see (c) of FIG. 8) so that different tone data from the last-acquired tone data can be acquired. Thus, even where the same audio signal is used, different tone data is acquired so that a different audio can be sounded on the basis of the different tone data, each time the tone data change timing arrives. As a result, the performance apparatus 1 can execute a variety of music performances.

According to the instant embodiment arranged in the above-described manner, the performance apparatus 1 can generate tones not only with internal tone colors but also with externally-acquired (i.e., external) tone colors, through execution of the external tone color setting process, with the result that it can execute a variety of performances with high ingenuity.

SECOND EMBODIMENT

Figure 9:
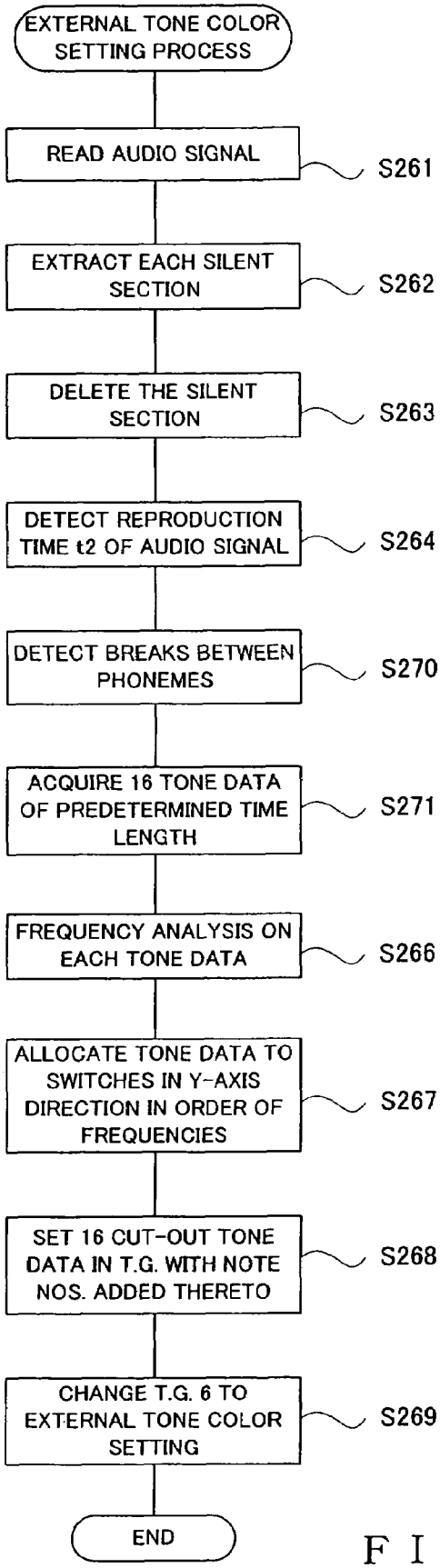
FIG. 9 is a flow chart of an external tone color setting process performed in a performance apparatus in accordance with a second embodiment of the present invention.
Figure 10:
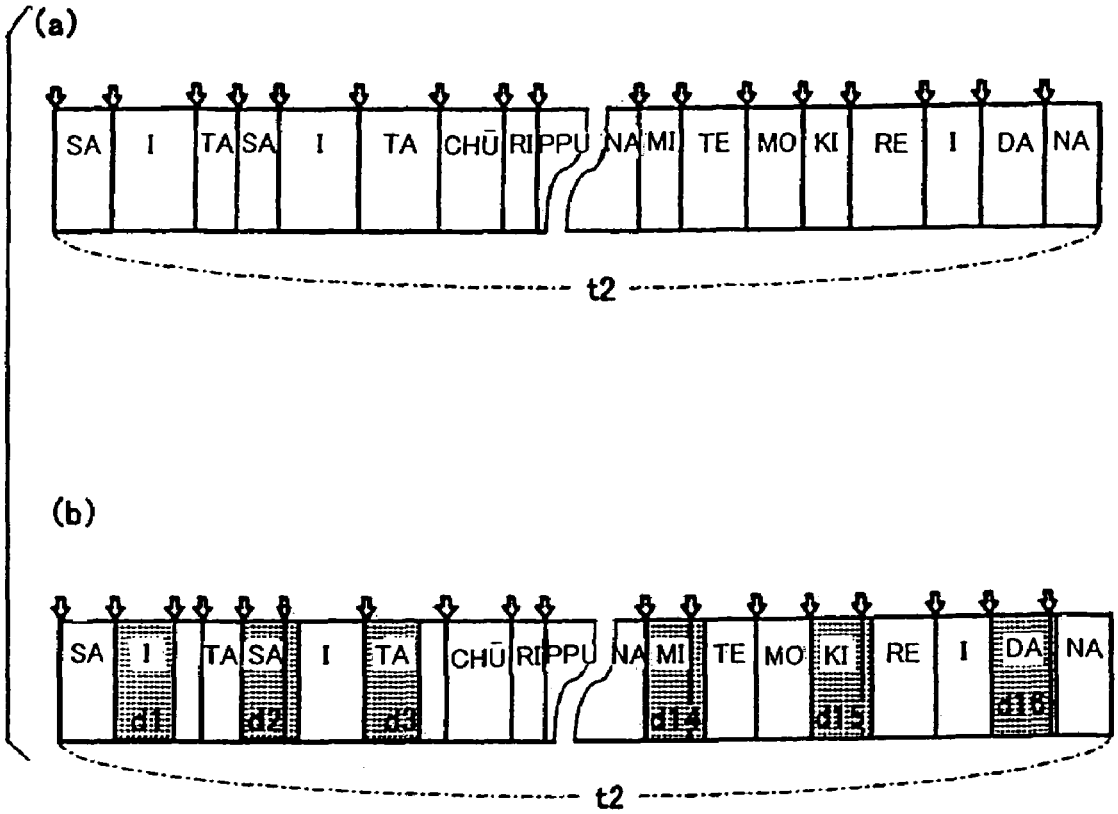
FIG. 10 is a diagram explanatory of an external tone color setting process performed in the second embodiment.

The following paragraphs a second embodiment of the present invention with reference to FIGS. 3, 9 and 10. The second embodiment is different from the first embodiment in that, whereas the first embodiment is arranged to randomly cut out tone data from an audio signal, the second embodiment is arranged to detect, from an audio signal, respective start positions of phonemes uttered by a person and then cut out sound data, each having a predetermined length from the corresponding start position, as tone data. Other structural arrangements and processing in the second embodiment are similar to those in the first embodiment and thus will not be described below to avoid unnecessary duplication.

FIG. 9 is a flow chart of an external tone color setting process performed in the second embodiment. FIG. 10 is a diagram explanatory of the external tone color setting process performed in the second embodiment. In FIG. 10, the same steps as in the external tone color setting process of FIG. 7 are indicated by the same reference characters as in FIG. 7 and will not be described to avoid unnecessary duplication. After execution of step S264, the tone data acquisition section 202*a* detects respective start positions of phonemes at step S270. In the case of an audio signal shown in (a) of FIG. 10, positions indicated by arrows are detected as the respective start positions of phonemes.

Example method for detecting the start positions of phonemes is now described. Generally, voice portions have more characteristic frequency components, such as formants, than non-voice portions. Therefore, the tone data acquisition section 202*a* divides an audio signal into a predetermined number of sampling data and performs frequency analysis on each of the sampling data to thereby detect phonemes on the basis of characteristic frequency components. The tone data acquisition section 202*a* determines breaks between the phonemes on the basis of variation over time of the characteristic frequency components and detects the breaks between the phonemes as the start positions of the phonemes.

Then, the tone data acquisition section 202*a* randomly selects 16 of the detected phoneme start positions and acquires 16 sound data (i.e., voice data) each having a predetermined length from the corresponding phoneme start position, at step S271. In this way, tone data d1-d16 are acquired as illustratively shown in (b) of FIG. 10.

With the second embodiment arranged in the above-described manner, sound data (i.e., voice data), each having the predetermined length from the corresponding phoneme start position in the audio signal, are acquired as tone data. Thus, the second embodiment can reliably prevent a sound of the tone data from starting at a point partway through the phoneme.

Various modification of the present invention are also possible as set forth below by way of example.

(1) Whereas the above-described first embodiment is arranged to randomly cut out tone data from an audio signal and the above-described second embodiment is arranged to randomly detect respective start positions of phonemes of an audio signal so as to cut out data, each having a predetermined length from the corresponding phoneme start position, as tone data, the present invention is not so limited. The present invention only has to be arranged so that different sections of an audio signal are cut out as individual tone data.

(2) Further, whereas, the first and second embodiments have been described as switching the tone data to be input to the tone generator 6, as an external tone color, every tone or sound-generating data change timing, the present invention is not so limited. For example, the present invention may be arranged so that same tone data is stored in the tone generator 6 and sound generation is effected using the same tone data until the tone generating data performance mode is canceled.

(3) Furthermore, whereas, in the first and second embodiments, tone data are allocated to the Y-coordinate locations of the switches 100 in the order of the pitch frequencies of the tone data, the present invention is not so limited, and it is only necessary that different tone data be allocated to the individual switches 100. For example, the cut-out data may be allocated to the individual switches 100 in the order they have been cut out, or in a random fashion.

(4) Furthermore, the method for executing a music performance using the switches 100 is not limited to the normal performance method as described above, or to a performance method based on automatic performance settings. For example, arrangements may be made such that, once the user depresses any one of the switches 100, other switches 100 (e.g., adjoining switches) are sequentially selected automatically so that sound generation corresponding to the other switches 100 is carried out.

(5) Furthermore, the arrangement of the switches of the switch group 10 is not limited to the matrix arrangement. In the first embodiment, it is only necessary that a plurality of the switches 100 be provided. In the second embodiment, the matrix arrangement of the switches 100 is not necessary as long as the switches 100 are arranged sequentially in given order.

(6) Furthermore, the performance apparatus of the present invention is not limited to the constructions of the first and second embodiments, and it may be constructed as an electronic piano, electone (trademark), etc., in which case a keyboard or the like functions as a group of the key switches.

What is claimed is:

1. A performance apparatus comprising:

a plurality of key switches disposed in a predetermined arrangement;

a memory that stores a plurality of tone data corresponding to the key switches;

a controller that samples an audio signal containing phonemes for a predetermined period, detects breaks between the phonemes contained in the sampled audio data, extracts a plurality of random sections, each containing a phoneme, from the sampled audio signal, detects the frequencies of the extracted random sections of tone data and associates the extracted random sections to the plurality of key switches in order of the frequencies, and writes the extracted plurality of random sections as the plurality of tone data into said memory;

a tone generation section that audibly sounds any one of the tones corresponding to the stored tone data with a corresponding designated one of the key switches, wherein each of the random sections is extracted from a start position of the respective phoneme for a predetermined length.

2. A performance apparatus as claimed in claim 1, wherein said controller detects and deletes any silent section of the audio signal before extracting the random sections.

3. A performance apparatus as claimed in claim 1, wherein said plurality of key switches are disposed in a matrix arrangement.

4. A performance apparatus as claimed in claim 3, wherein individual X-coordinate locations in the matrix arrangement of the key switches are generated at mutually exclusive times by said tone generation section.

5. A performance apparatus as claimed in claim 3, wherein individual Y-coordinate locations in the matrix arrangement of the key switches correspond to mutually-different tone pitches.

6. A performance apparatus as claimed in claim 3, wherein the individual Y-coordinate locations in the matrix arrangement of the key switches correspond to mutually-different tone data.

7. A performance apparatus as claimed in claim 1, further comprising a note table storing correspondence between said plurality of key switches and notes based on pitches of the tone data associated with the key switches.

8. A performance apparatus as claimed in claim 1, wherein said tone generation section audibly sounds any one of the tone data corresponding to one of the switches designated in response to activation thereof.

9. A performance apparatus as claimed in claim 1, further comprising:

a storage section that stores ON/OFF states of said plurality of key switches in correspondence with a desired music performance; and a readout control section that reads out the ON/OFF states of said plurality of key switches from said storage section in response to a reproductive performance instruction, wherein said tone generation section audibly sounds the tone data corresponding to the key switches designated in accordance with the ON/OFF states read out via said readout control section.

10. A method of generating audible sounds with a performance apparatus that includes a plurality of key switches disposed in a predetermined arrangement, a memory that stores a plurality of tone data corresponding to the key switches, and a tone generation section that audibly sounds any one of the tones corresponding to the stored tone data with a designated one of the key switches, said method comprising the steps of:

sampling an audio signal containing phonemes for a predetermined period;

detecting breaks between the phonemes contained in the sampled audio data;

extracting a plurality of random sections, each containing a phoneme, from the sampled audio signal, wherein each of the random sections is extracted from a start position of the respective phoneme for a predetermined length;

detecting the frequencies of the extracted random sections and associating the extracted random sections to the plurality of key switches in order of the frequencies;

writing the extracted plurality of random sections as the plurality of tone data into said memory; and audibly sounding via said tone generation section any one of the tones corresponding to the stored tone data with the corresponding designated key switch.

11. A computer-readable medium storing a computer program for controlling a performance apparatus to generate audible sounds, said performance apparatus including a plurality of key switches disposed in a predetermined arrangement, a memory that stores a plurality of tone data corresponding to the key switches, and a tone generation section that audibly sounds any one of the stored tone data with a designated one of the key switches, the program including instructions for:

sampling an audio signal containing phonemes for a predetermined period;

detecting breaks between the phonemes contained in the sampled audio data;

extracting a plurality of random sections, each containing a phoneme, from the sampled audio signal, wherein each of the random sections is extracted from a start position of the respective phoneme for a predetermined length;

detecting the frequencies of the extracted random sections and associating the extracted random sections to the plurality of key switches in order of the frequencies;

writing the extracted plurality of random sections as the plurality of tone data into said memory; and audibly sounding via said tone generation section any one of the tones corresponding to the stored tone data with the corresponding designated key switch.

* * * * *